US005481889A

United States Patent [19]

Richard et al.

[11] Patent Number: 5,481,889

[45] Date of Patent: Jan. 9, 1996

[54] MECHANICAL LATCH SYSTEM

[75] Inventors: John E. Richard, Rogers; David B. Wightman, White Bear Lake; Clifford A. Klinger, Minneapolis; Steven J. Hammond, Andover; Joseph D. Ricke, Arden Hills, all of Minn.

[73] Assignee: Federal-Hoffman, Inc., Anoka, Minn.

[21] Appl. No.: 5,013

[22] Filed: Jan. 15, 1993

[51] Int. Cl.[6] ..... E05B 63/14

[52] U.S. Cl. ..... 70/118; 70/63; 292/39; 292/142; 292/DIG. 37

[58] Field of Search ..... 70/57, 58, 63, 70/67, 69, 73, 78, 82, 83, 118, 120, 134, 130; 292/DIG. 37, 39, 41, 142

[56] References Cited

U.S. PATENT DOCUMENTS

| | | | |
|---|---|---|---|
| 1,088,399 | 2/1914 | Bradshaw | 292/39 |
| 1,110,007 | 9/1914 | Putnam | 292/39 |
| 1,136,254 | 4/1915 | Mosler et al. | 70/118 |
| 2,821,770 | 2/1958 | Gruber | 70/120 X |
| 3,545,799 | 12/1970 | Gertsfield | 70/120 X |
| 3,837,692 | 6/1973 | Ayers et al. | 70/63 X |
| 4,002,360 | 1/1977 | Frank et al. | 292/142 X |
| 4,547,006 | 10/1985 | Castanier | 292/41 X |
| 4,676,370 | 6/1987 | Rudick | 70/63 X |
| 4,986,582 | 1/1991 | Sting et al. | 292/39 X |
| 5,172,944 | 12/1992 | Munich et al. . | |
| 5,253,903 | 10/1993 | Daley | 292/39 |

FOREIGN PATENT DOCUMENTS

| | | | |
|---|---|---|---|
| 1806799 | 8/1969 | Germany | 292/DIG. 37 |

OTHER PUBLICATIONS

21–page brochure entitled, "EMKA Beschlagteile", EMKA, Inc., Pennsylvania, 1991.

6–page brochure entitled, "Catalogue 91/92", (U.K. Edition), Sarel Limited, Bedfordshire, England, 1991.

*Primary Examiner*—Peter M. Cuomo
*Assistant Examiner*—Suzanne L. Dino
*Attorney, Agent, or Firm*—Merchant, Gould, Smith, Edell, Welter & Schmidt

[57] ABSTRACT

A latching apparatus includes a rack and pinion drive. A latch bar slide between a latched and unlatched position with ramped latching members mounted on the bar engaging complementary latching members. The latch connects to several types of latch actuators including a button actuator having rotation indicating means. The latch is also configured to connect to a keyed latch actuator and a push-button actuator.

20 Claims, 7 Drawing Sheets

MECHANICAL LATCH SYSTEM

BACKGROUND OF THE INVENTION

1. Field of the Invention

The present invention relates to a mechanical latch system such as is commonly used with a sealed container having a lid.

2. Description of the Prior Art

Latch mechanisms for containers which require a watertight or sealed enclosure are well-known. Typically, a gasket must be compressed in order to seal off the interior of the container. Such containers are often used to protect electronics, electrical devices, and other components in harsh or corrosive environments, such as waste treatment plants, chemical facilities, and other facilities which have hazardous or reactive materials. In such environments, the latch must be durable and easy to operate as well as providing pressure against the entire gasket so that the interior of the container remains sealed.

In addition, needs for the types of latches and handles which are used with the containers vary with the application. With some applications, it is preferred to simply close the container in a latched position, while in other applications, it may be necessary to have a keyed lock or have a latch mechanism capable of being locked with a padlock. In addition, it is preferred that it is clearly marked which way the latch mechanism needs to be rotated in order to latch or unlatch the system. The latching mechanism should also provide a mechanical advantage to aid in tightly closing the seal.

Prior latch mechanisms require many interacting parts and a pair of moving latch bars which may fail. The prior latches often do not provide evenly-applied pressure to the gasket. In addition, some latches do not provide a stop to prevent movement of the latch in a latched or fully unlatched position, making it difficult for a user to determine which way to turn the latch mechanism or what position the latch is at. Prior latching systems provided for locking the lid, but included actuator members which could be easily removed with simple hand tools so that the containers were not secure from theft or vandalism.

It can be seen then that an improved latch mechanism is needed which provides easy latching and unlatching, and which provides clear direction to a user how to actuate the mechanism. Furthermore, the latch should be adaptable to a variety of latching needs providing several levels of security. It can be further appreciated that such a latch mechanism should not adversely impact the integrity of seal with the container and should provide reliable latching with a minimum of moving parts while having high durability under harsh conditions. The exposed portions of the latch must be able to withstand the harsh environments in which the latch may be used without being easily removed when the latch is locked.

SUMMARY OF THE INVENTION

The present invention is directed to a latch mechanism as may be used with containers having a hinged lid. In particular, the present invention is directed to a latch which is used with a sealed box which is commonly used for protecting electrical components or electronics in harsh environments.

According to the present invention, the lid includes a rack and pinion drive which is utilized to slide a latch bar. Rotation of the pinion gear of the rack and pinion moves the rack member, and therefor slides the latching bar. With this arrangement, the latch mechanism is latched and unlatched by rotating the pinion gear. The latch bar includes a number of latching members which engage complementary latching members mounted on the box portion to seal the lid against the box. The latching members have ramped surfaces which aid in closing the lid and in aligning the complementary latching members.

The present invention provides for interchangeable latch handles which may be required for various latching needs. The latch may have a knob type actuator connected to the pinion gear which is rotated to latch and unlatch the latching mechanism. The knob also includes a tab which covers a portion of a rotation indicator so that an arrow indicates which direction the knob should be rotated to latch or unlatch the mechanism.

The present invention also provides for a key actuated latch which can be locked. A key cylinder inserts into an integrated enclosure and handle which may be rotated to latch and unlatch the mechanism. The key actuated embodiment connects to the pinion gear in the same manner as the button type embodiment. The key rotates a rotation limiting member which engages a elevated portion of the lid to prevent rotation of the handle/enclosure in a locked position. When the key is turned to an unlocked position, the rotation limiting member is turned and allows for free rotation of the handle.

The present invention also provides for a push-button actuated latch which may be locked. The push-button includes an enclosure and handle which connects to the pinion gear in the same manner as the other latch actuators. The enclosure includes an orifice which may receive a padlock or other pin or lock. A flange which connects to the push-button covers the orifice in the unlocked position and is lowered to uncover the orifice in the locked position. The flange connects to a rotation limiting member which is mounted to the push-button. The rotation limiting member engages an elevated portion of the container lid in the lowered position to lock the latch mechanism and is raised above the elevated portion when the button is at its upper position. The button is biased in an upper position by a spring engaging the enclosure. Depressing the button lowers the rotation limiting member and the flange. At this position, the latch cannot be rotated and the flange is lowered so the orifice may receive a lock or pin.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding structure throughout the several views.

DETAILED DESCRIPTION OF THE PREFERRED EMBODIMENT(S)

Figure 1:
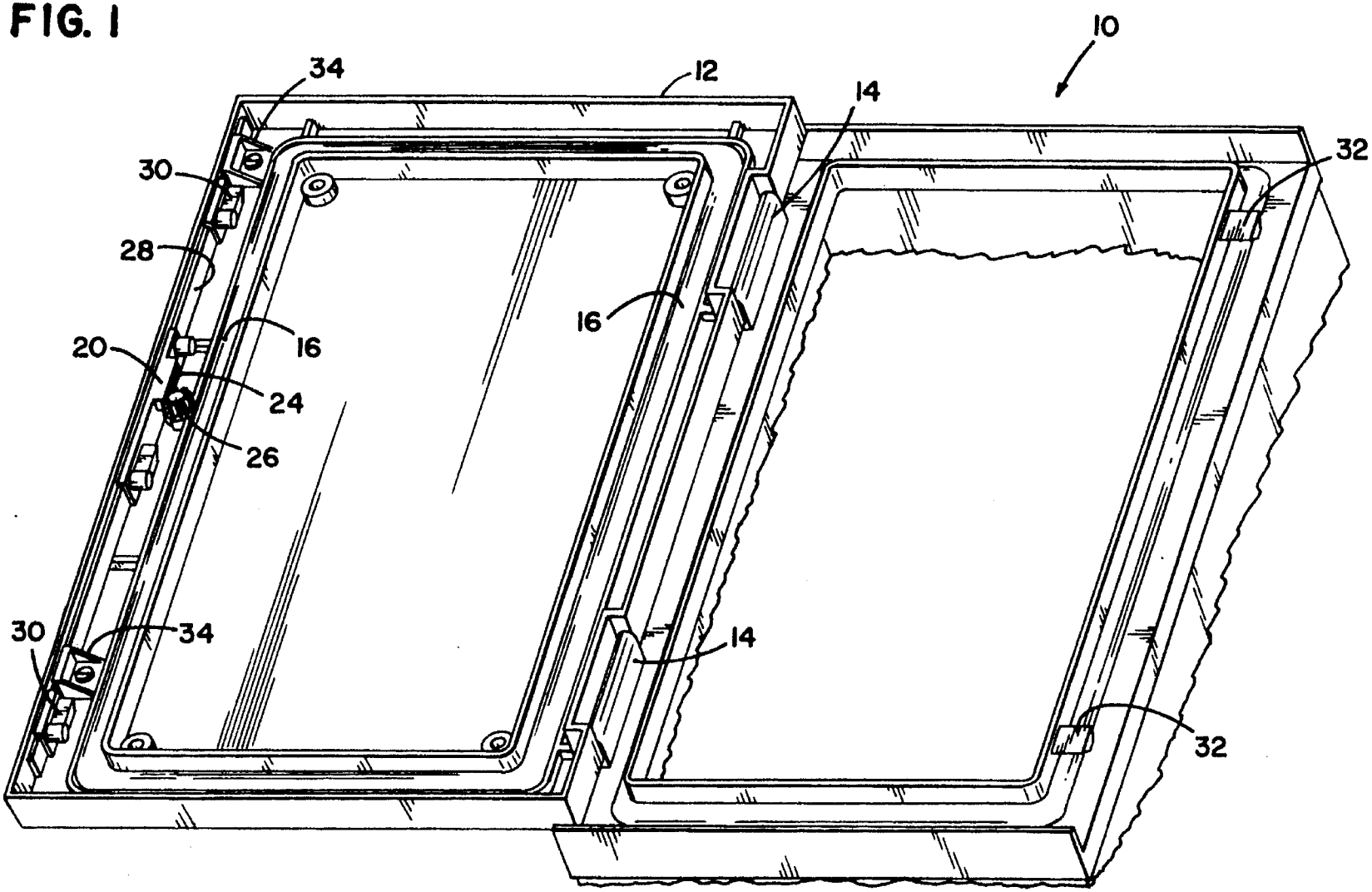
FIG. 1 shows a perspective view of a container and lid in the open position including a latch apparatus according to the principles of the present invention.

Referring now to the drawings, wherein like reference numerals designate corresponding structure throughout the views, and referring in particular to FIG. 1, there is shown a container, shown as a box, generally designated 10. As shown, a lid 12 is mounted on hinges 14 to the box 10. However, it may be appreciated that the lid could be detachable or otherwise connected to the box 10. The box 10 may be used for protecting electrical or other components in a harsh environment such as a petrochemical plant or waste treatment facility, in which it is important that the components are protected from any corrosive materials which may be present. Therefore, a gasket 16 is utilized to preserve the box 10 in a sealed condition. With the box 10 shown, a latch apparatus 20 is positioned along an edge of the lid 12 opposite the hinges 14. In this manner, pressure is applied to all four corners of the box 10 so that the gasket 16 has pressure applied to all portions in order to provide a satisfactory seal.

Figures 2, 10:
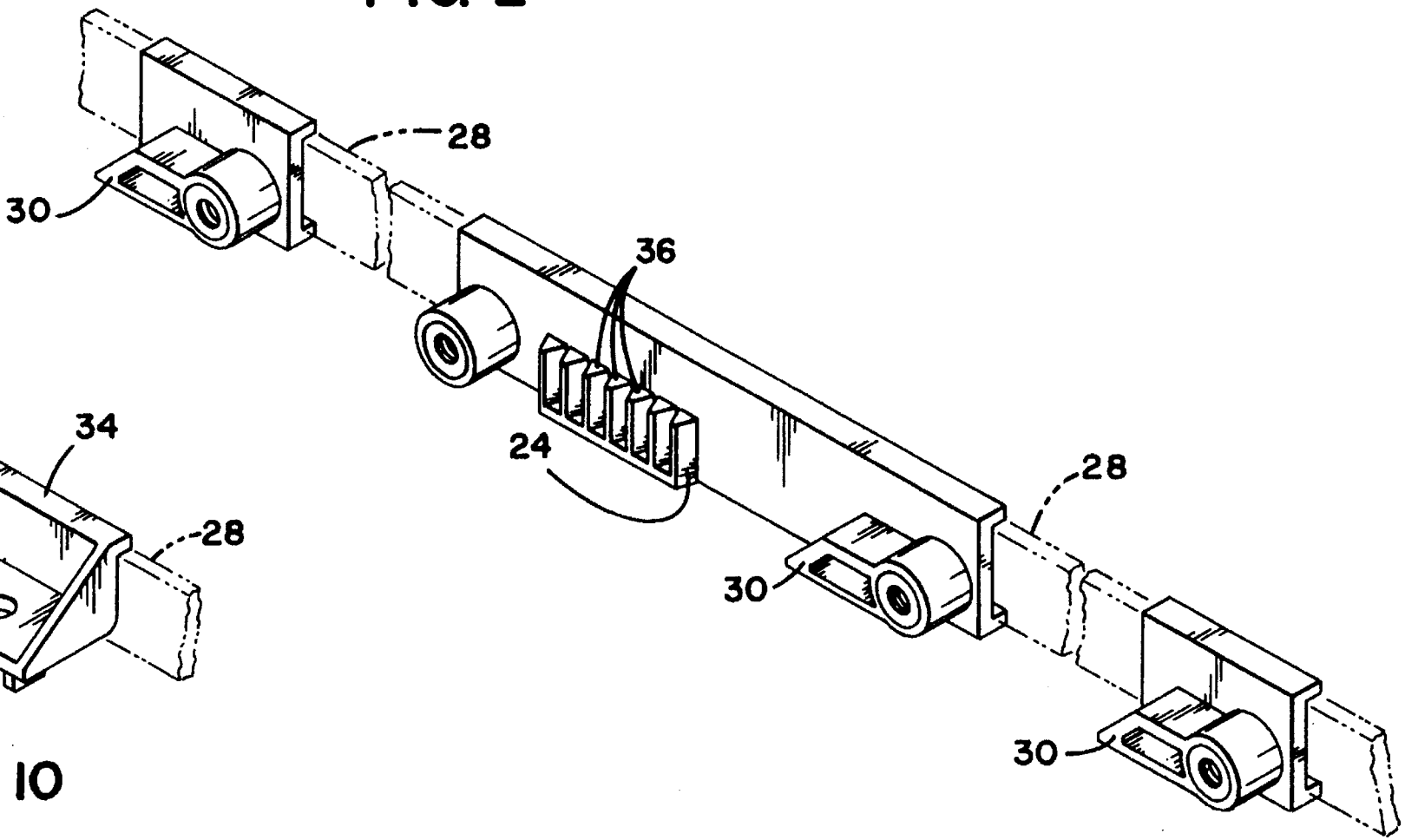
FIG. 2 shows a perspective view of a sliding latch bar and rack and pinion drive for the latch apparatus shown in FIG. 1.

Referring now to FIG. 2, there is shown a portion of the latch mechanism 20 including a latch bar 28 having latching members 30 and a rack 24 of a rack and pinion drive mounted thereon. The bar 28 is laterally movable along the edge of the lid 12 and is retained by bar retainers 34, shown in FIG. 10. In this manner, the bar 28 is slidably mounted between the latched and unlatched position with the latch members 30 engaging ramped members 32 mounted on the box 10, as shown in FIG. 1. With this arrangement, the ramped latching members 30 engage the complementary ramped latching members 32 to provide mechanical advantage when latching and unlatching the lid 12, thereby providing for easier latching with minimal effort required. This arrangement also provides more reliable latching as the latch members 30 and 32 are more likely to engage when both surfaces are ramped, as the members are substantially self-aligning.

Figure 3:
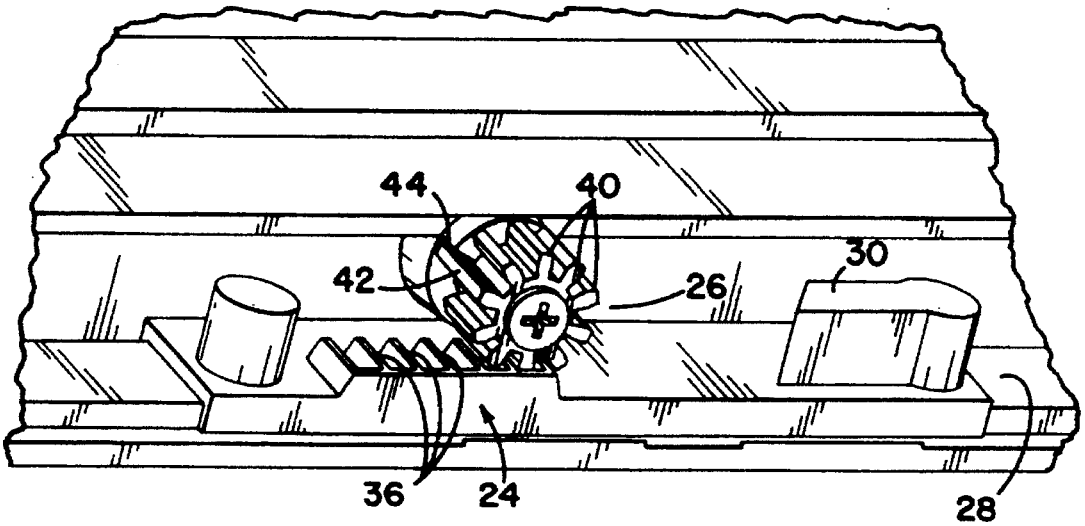
FIG. 3 shows a perspective detail view of the rack and pinion drive shown in FIG. 2 in the latched position.
Figure 4:
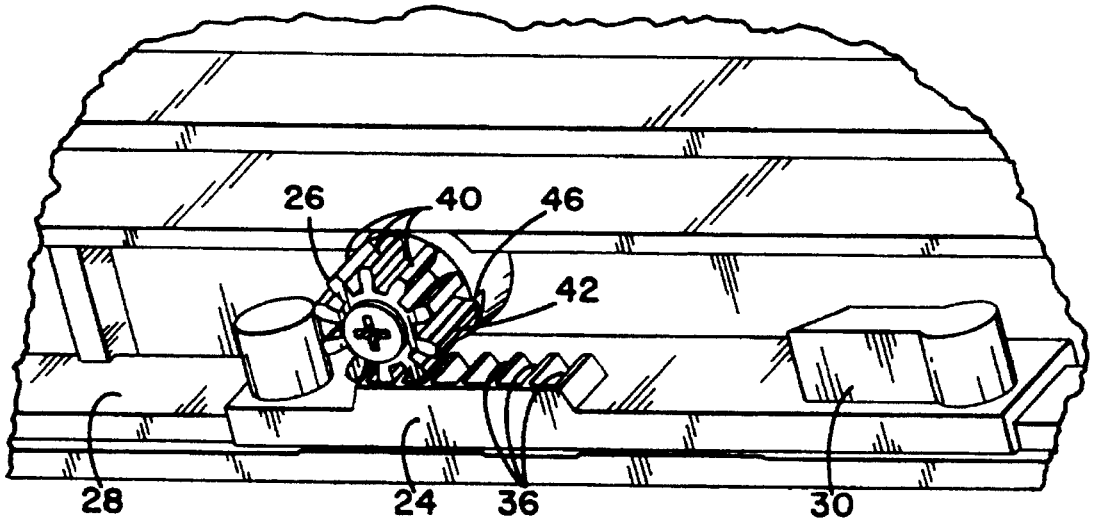
FIG. 4 shows a perspective detail view of the rack and pinion drive shown in FIG. 2 in the unlatched position.

As shown in FIG. 3, the rack 24 and a pinion gear 26 operate to slide the latch bar 28 between a latched and unlatched position. The bar 28 is shown in the latched position of FIG. 3, however the box latch members 32 are not shown engaging the lid latch members 30 in FIG. 3 for clarity purposes. In the latched position, the pinion gear 26 is at a first end of the rack 24 with the teeth 40 of the pinion gear 26 engaging the teeth 36 of the rack. An elongated tooth 42 of the pinion gear 26 engages a stop 44 on the lid 12 to prevent further rotation between the rack and pinion so that the pinion gear 26 stops at the end of the rack 24. In this position, the lid latch members 30 on the bar 28 are moved to engage the latch members 32 of the box, thereby latching the lid 12. By rotating the latch actuating apparatus as explained hereinafter, the pinion gear 26 is rotated so that the teeth 40 of the pinion gear 26 move the rack 24 to the right, as shown in FIGS. 3 and 4. This slides the entire bar 28, including the latch members 30 so that the latch members 30 on the lid 12 no longer engage latch members 32 of the box 10. At this position, the entire latch mechanism 20 is unlatched and the lid 12 may be freely opened or closed. A stop 46 on a molded portion of the lid 12 prevents further rotation of the pinion gear 26 beyond the fully unlocked position. It can be appreciated that the pinion gear 26 and the rack 24 provide for engagement and alignment as well as positioning at both ends of the latch's range of movement. This arrangement also provides for movement of a single bar rather than more complicated movements of two bars, as was done with prior latch mechanisms.

Figure 5:
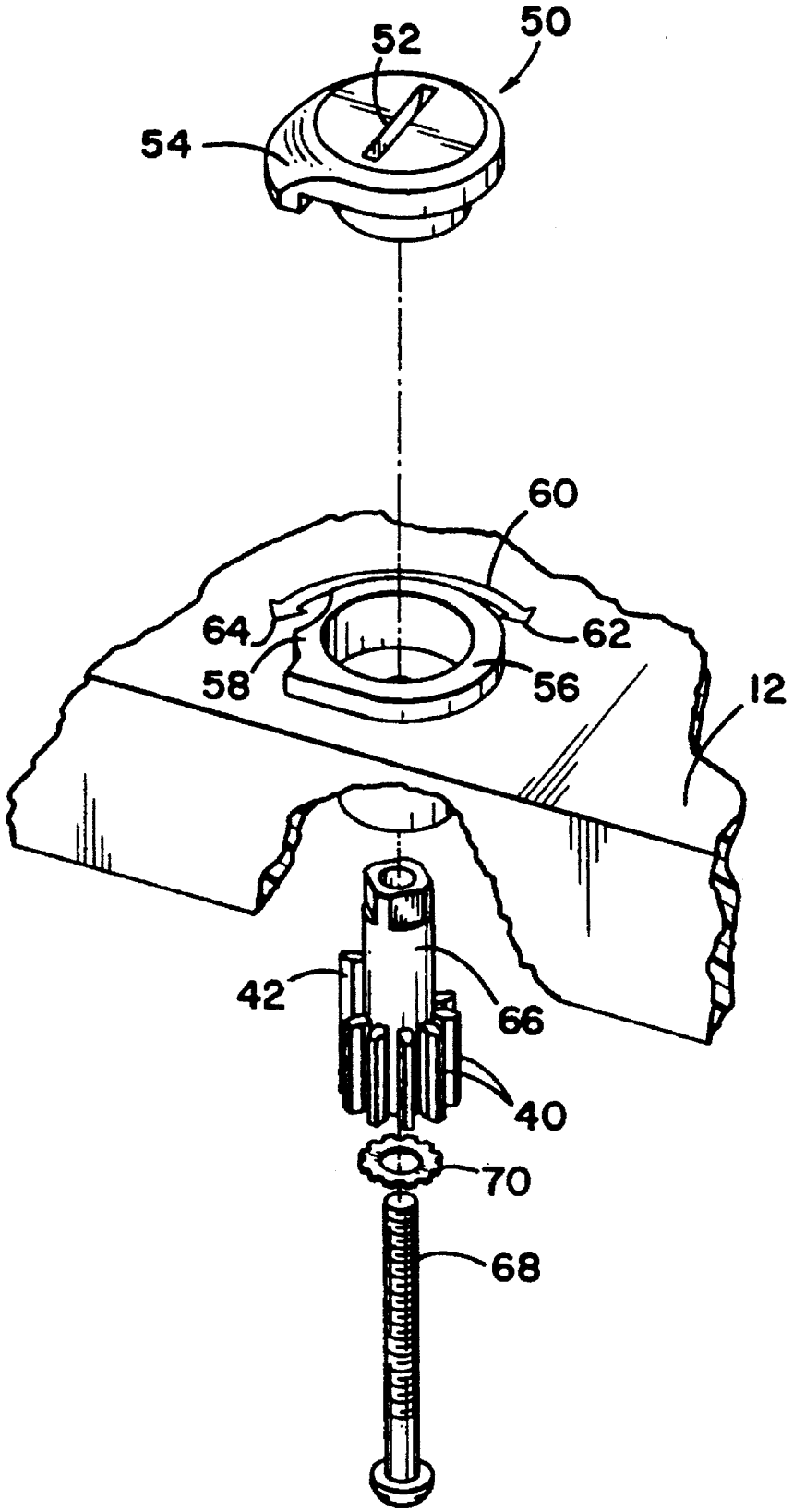
FIG. 5 shows an exploded perspective view of a first embodiment of a latch actuating device according to the principles of the present invention.

Referring now to FIG. 5, there is shown a first embodiment of a latch actuating device having a rotatable latch button or knob 50 with a slot 52 formed therein. The latch button 50 may also include a tab 54 which is utilized for indicating rotation direction, as explained hereinafter. The latch knob 50 is rotated by inserting a screwdriver or other suitable tool into the slot 52 and then rotating. Rotating the knob or button also rotates the pinion drive member 66 which includes the engaging teeth 40. The pinion drive member 66 includes a squared end portion to engage the knob and is connected to the button or knob 50 by a bolt 68 with a washer 70 spaced therebetween. Rotation of the pinion drive member 66 moves the pinion gear 26 and the rack 24 between the latched and unlatched positions shown in FIGS. 3 and 4. The tab 54 also engages a molded scallop 56 on the lid 12 having a rotation limiting portion 58 formed therein. The rotation limiting portion 58 of the scallop 56, along with stops 44 and 46 shown in FIGS. 3 and 4, limit the rotation of the latch knob 50. Therefore, rotation stops when the latch mechanism 20 is in either the fully latched or fully unlatched position only.

Figure 6:
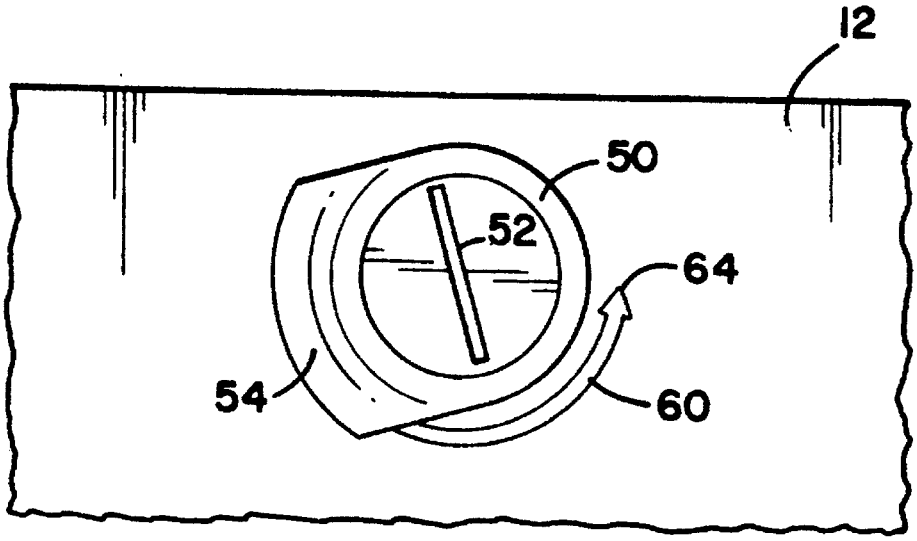
FIG. 6 shows a top plan view of the latch actuating device shown in FIG. 5 in the unlatched position.
Figure 7:
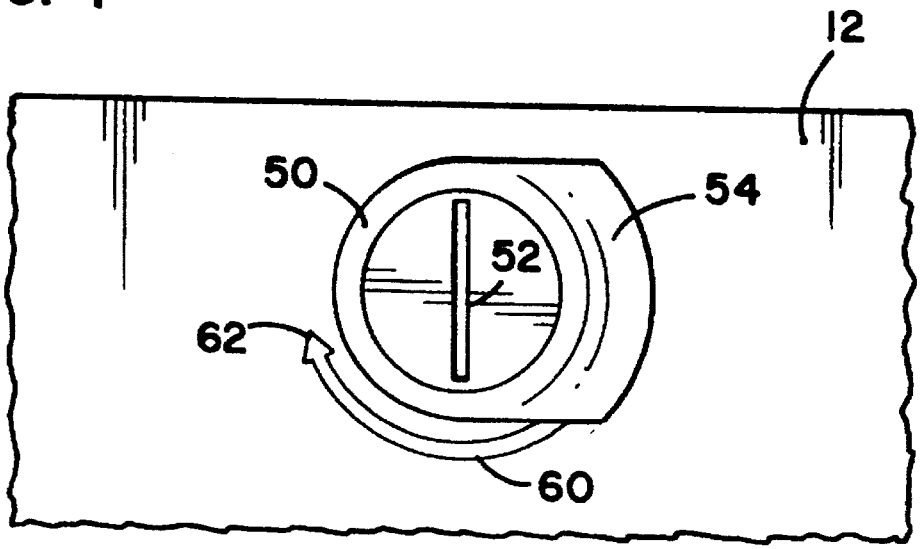
FIG. 7 shows a top plan view of the latch actuating device shown in FIG. 5 in the latched position.

As shown in FIGS. 6 and 7, the tab 54 also covers a portion of a direction indicator 60 on the lid 12 including arrows 62 and 64. As shown in FIG. 6, when the latching apparatus is in the unlatched position, the directional arrow 62 of direction indicator 60 is covered by tab 54. Therefore, when viewing the knob 50 and the direction indicator 60, only directional arrow 64 is revealed, indicating that the knob 50 should be rotated in a counterclockwise direction to latch the apparatus. In a similar manner, as shown in FIG. 7, when the latch apparatus is in the latched position, the tab 54 covers the directional arrow 64 of the direction indicator 60. When the direction indicator 60 and the tab 54 are viewed in this position, only the directional arrow 62 is revealed. Therefore, it is readily apparent that the knob 50 must be rotated in the clockwise direction to unlatch the apparatus. It can be appreciated that no additional elements are required to indicate turning direction and that only the knob tab 54 and the direction indicator 60 are required. It can be further appreciated that it is always apparent which direction the knob should be rotated in order to either latch or unlatch the latching mechanism. In addition, if both arrows 62 and 64 are visible, it is apparent that the latch is in neither the fully latched nor the fully unlatched position.

Figure 8:
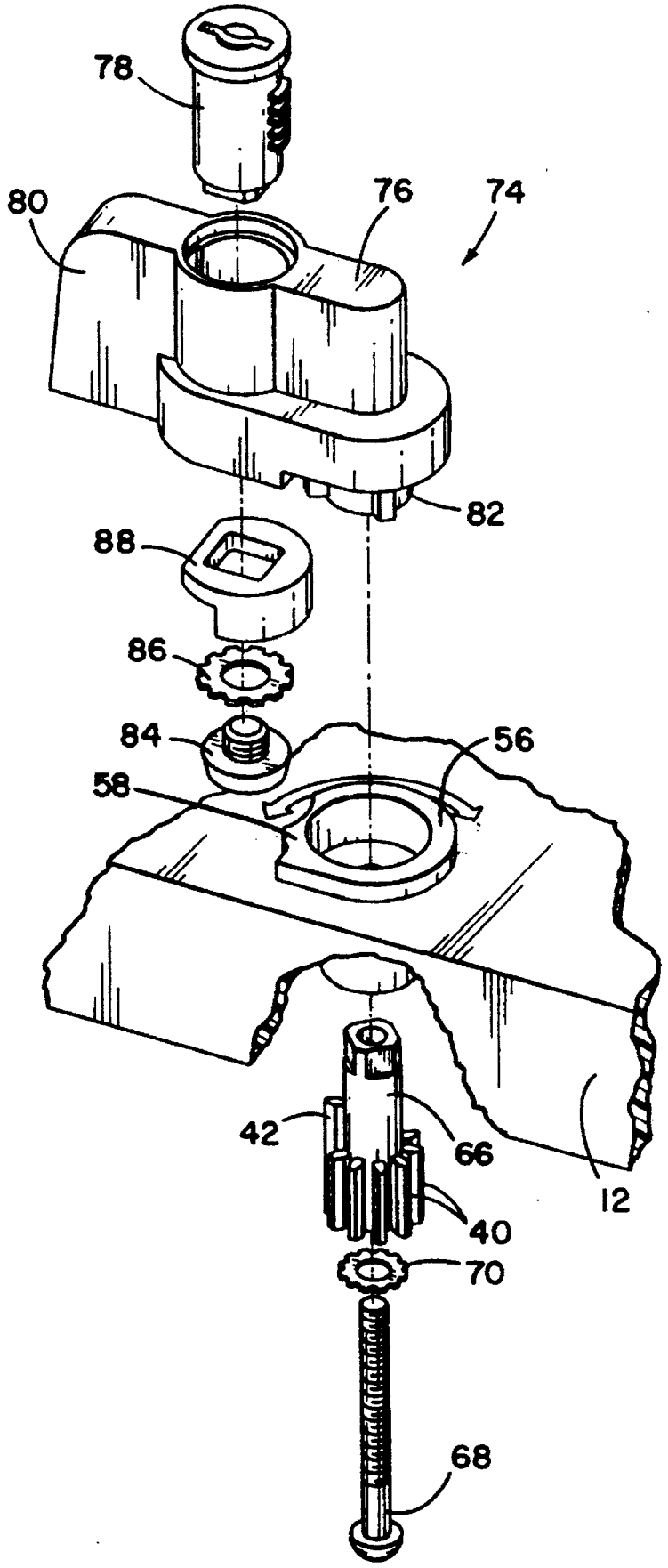
FIG. 8 shows a second embodiment of the latch actuating device having means for locking the latch with a key.

Referring now to FIG. 8, there is shown a second embodiment of a rotatable latch actuating device, designated 74. The embodiment shown utilizes a locking capability so that the latch may be locked with a key. The key actuated latch actuator device 74 includes a key cylinder 78 which inserts into an enclosure 76. The enclosure is integrated with a handle portion 80. Extending from the enclosure 76 is a latch connecting member 82. The connector member 82 inserts through scallop 56 on the lid 12 having an orifice to engage a squared end of the pinion drive, member 66 and is connected with washer 70 and bolt 68. In the unlatched position, the handle 80 may be held to turn the enclosure 76 which actuates the pinion drive member 66 to lock the latch. The key-actuated latching device 74 can also be used with the direction indicator 60, shown more fully in FIGS. 6 and 7, to indicate to the user which direction to rotate the enclosure 76.

To lock the key-actuated device 74, the key is inserted in a lock cylinder 78 which is rotated to a locked position. The lock cylinder 78 is connected to a retaining member 88 which is held in place by bolt 84 and washer 86. The lower portion of the retaining member 88 is hemispherically shaped so that in a first latched position, the curved edge of the hemisphere portion engages the complementary concave shaped retaining portion 58 of the scallop 56. To unlock the latch, the lock cylinder 78 is rotated so that the retaining member 88 is also rotated to a position whereat the lower hemispheric portion does not engage the shaped engaging portion 58 of the scallop 56.

Figure 9:
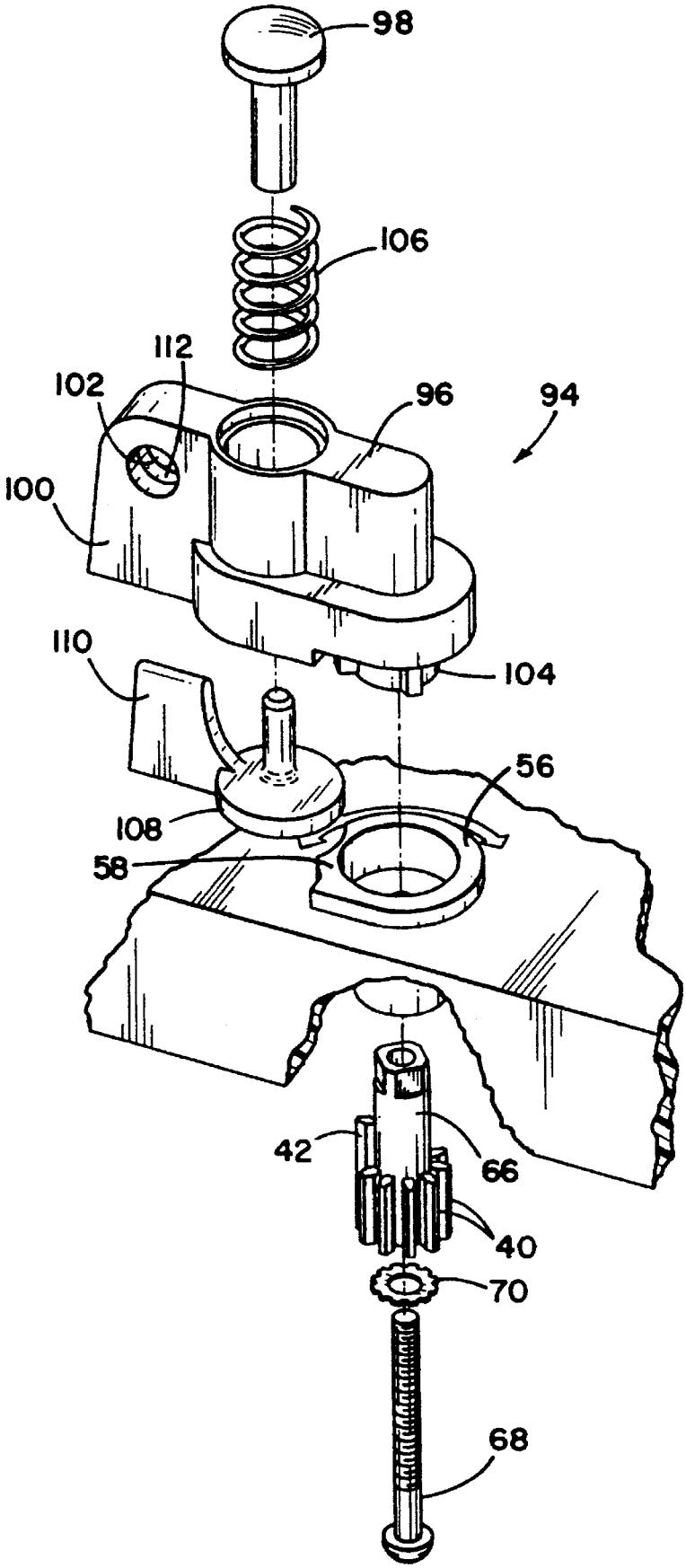
FIG. 9 shows a third embodiment of the latch actuating device having means for locking the latch with a padlock; and, FIG. 10 shows a perspective view of a latch bar retainer and a portion of the latch bar.

Referring now to FIG. 9, there is shown another embodiment of the apparatus having a rotatable push-button actuated locking device 94. The push-button actuated latch actuator 94 includes an enclosure 96 with a connecting member 104 and an integrated handle 100. The handle 100 includes an aperture 102 formed therethrough for receiving a padlock or other locking means to lock the latch, as explained hereinafter. The insert portion 104 inserts through molded scallop 56 to engage the squared end portion of the pinion drive member 66, as with other embodiments. The enclosure 96 includes a sliding push-button 98 attaching to a retaining member 108 having a flange 110. The flange slides up and down with the push-button 98 and retaining member 108 within the handle portion 100 of the enclosure 96. A spring 106 engages the push-button 98 and a portion of the enclosure 96 to bias the push-button 98 and the retaining member 108 in a raised position. At this position, the spacer retaining member 108 is raised above the scallop 56. In this position, the latch is unlocked and the actuator 94 may be freely rotated.

When the push-button 98 is depressed against the force of the spring 106, the retaining member 108 is lowered so that its curved edge engages the retaining portion 58 of the scallop 56. At this position, the latch actuator 94 cannot be rotated so that the latch is locked. As the flange 110 extends upward through a space 112 extending upward through the enclosure 96, when the flange is fully raised, it covers the opening 102 in the handle 100. When the push-button 98 is depressed to the locked position so that the spacer portion 108 engages the shaped portion 58 of the scallop 56, the flange 110 is lowered below the aperture 102. Therefore, by inserting a lock or other pin through the aperture 102, the flange 110 is forced against an inserted pin or lock and is prevented from rising to cover the aperture 102. Therefore, the latch-actuator 94 is prevented from rotating and the latch is locked. It can be appreciated that various types of cotter pins or padlocks may be inserted through the aperture 102 to lock the locking mechanism.

It can be appreciated that all embodiments of the present invention include latching handles and actuator portions which connect to the pinion drive member in the same way so that various types of locks and actuator handles may be utilized with the same latching system. It can also be appreciated that although the latch handle portions may be removed and replaced with other types of actuators, all of the embodiments are mounted to the container to prevent removal of the latch actuator members from the outside of the container, thereby improving the security of the latching system.

As can also be appreciated, the latching apparatus is entirely outside of the gasket 16 and the enclosed portion of the container 10. Therefore any corrosion to the latch apparatus 20 will not affect the integrity of the container 10 or the seal with the gasket 16. However, since the environment of the container is often harsh, and latch elements may rust or otherwise deteriorate, the enclosures 76 and 96 are made of a durable elastomer in the preferred embodiment, and the bar 28 and other metal elements are made of a stainless steel.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A latch apparatus for a container and lid, comprising:

a rack and pinion drive device mounted on the lid, wherein the rack is mounted to a latch bar, and wherein the latch bar slides with the rack upon rotation of a pinion gear, wherein the latch bar includes a plurality of engagement members mounted thereon engaging complementary members on the container;

latch actuation means rotatable with the pinion gear in a normal position; wherein the latch actuation means is unlocked in its normal position; and, a plurality of interchangeable latch actuation devices for actuating the rack and pinion drive device; wherein the plurality of interchangeable latch actuation devices have a plurality of different latch actuation means.

2. A latch apparatus according to claim 1, wherein the engagement members include a ramped surface for engaging the complementary members.

3. A latch apparatus according to claim 2, wherein the complementary members include a complementary ramped surface for engaging the ramped surface of the engagement members.

4. A latch apparatus according to claim 1, wherein the latch bar includes engagement members at opposed ends of the bar.

5. A latch apparatus according to claim 1, wherein the pinion includes an elongated tooth, and wherein the lid includes stop members, wherein the elongated tooth engages the stops to prevent further rotation of the pinion gear.

6. A latch apparatus according to claim 1, wherein the latch bar extends from both directions of the rack and pinion drive.

7. A latch apparatus according to claim 1, wherein the latch apparatus is mounted exteriorly of a gasket between the lid and the container.

8. A latch apparatus according to claim 1, wherein the latch apparatus is mounted along an edge opposite a hinge on the container.

9. A latch system for latching a container and lid, comprising:

a latching mechanism selectively configured for connecting to a plurality of interchangeable alternative latch actuating devices, including:

a non-locking latch actuation device for actuating the container latch;

a key actuated latch actuation device for actuating the container latch, wherein a key is utilized to lock the key actuated latch actuation device;

a push-button latch actuation device for actuating the container latch, wherein a spring-loaded button is depressed to lock the push-button latch actuation device.

10. A latch system according to claim 9, wherein the push-button latch actuation device means includes means for receiving a padlock to prevent the spring-loaded button disengaging.

11. A latch system according to claim 9, wherein the latching system includes rack and pinion drive means for moving the latching mechanism between a latched position and an unlatched position.

12. A push-button latch actuator for actuating a latch mechanism, comprising:

an enclosure having an orifice formed therethrough and means for connecting to the latch mechanism and configured to accept a push-button;

a button slidably mounted in the enclosure for moving between a first lowered position and a second raised position, wherein the button includes a flange, and wherein the flange exposes the orifice in the first lowered position and covers the orifice in the second raised position;

rotation limiting means for preventing rotation of the enclosure in the first lowered position, and allowing free rotation in the second raised position, wherein the rotation limiting means includes a fixed concave shaped retainer member and a curved member mounted to the button, and wherein the curved member engages the retainer member in the first lowered position and the curved member clears the retainer member in the second raised position; and, biasing means engaging the button for forcing the button upward to the second raised position.

13. A push-button latch actuator according to claim 12, further comprising a stationary stop, wherein the stop is engaged by the enclosure when the push-button is lowered.

14. A push-button latch actuator according to claim 12, further comprising rotation indicating means for indicating which direction to rotate the actuator.

15. A push-button latch actuator according to claim 12, wherein the rotation limiting means comprises a raised scallop attached to a mounting surface.

16. A push-button latch actuator according to claim 12, wherein the latch mechanism includes rack and pinion drive means for moving the latching mechanism between a latched position and an unlatched position.

17. A keyed latch actuator for actuating a latch mechanism, comprising:

a key-actuated lock cylinder;

an enclosure having means for connecting to the latch mechanism and configured to accept a keyed lock cylinder;

a raised scallop mounted on the enclosure including a concave retainer surface;

rotation limiting means for preventing rotation of the enclosure in a first position, and allowing rotation in a second position, wherein the rotation limiting means includes a hemispheric shaped member including a curved edge and a straight edge mounted to the lock cylinder, and wherein rotation of the lock cylinder moves the rotation limiting means between the first position wherein the curved edge engages the retainer surface and the second position wherein the curved edge rotates out of engagement with the retainer surface.

18. A keyed latch actuator according to claim 17, further comprising rotation indicating means for indicating which direction to rotate the actuator.

19. A keyed latch actuator according to claim 17, wherein the latch mechanism includes rack and pinion drive means for moving the latching mechanism between a latched position and an unlatched position.

20. A keyed latch actuator according to claim 17, wherein the rotation limiting means comprises a hemispherical member connected to the lock cylinder and rotating with the lock cylinder and a stationary complementary member engaging the hemispherical member in the first position, wherein the hemispherical member rotates out of engagement in the second position.

* * * * *